US007018968B2

(12) United States Patent
Hsu et al.

(10) Patent No.: US 7,018,968 B2
(45) Date of Patent: Mar. 28, 2006

(54) LIQUID LAUNDRY DETERGENT WITH POLYANIONIC AMMONIUM SURFACTANT

(75) Inventors: Feng-Lung Gordon Hsu, Tenafly, NJ (US); Yun Peng Zhu, Fairlawn, NJ (US); Tamara Padron, North Bergen, NJ (US); Kimball James Woelfel, River Edge, NJ (US)

(73) Assignee: Unilever Home & Personal Care USA, Greenwich, CT (US)

( * ) Notice: Subject to any disclaimer, the term of this patent is extended or adjusted under 35 U.S.C. 154(b) by 106 days.

(21) Appl. No.: 10/664,310

(22) Filed: Sep. 17, 2003

(65) Prior Publication Data

US 2005/0059572 A1 Mar. 17, 2005

(51) Int. Cl.
*C11D 17/00* (2006.01)

(52) U.S. Cl. ..... 510/357; 510/424; 510/494; 510/499; 510/394

(58) Field of Classification Search ..... 510/276, 510/357, 426, 494, 499, 394, 424, 492, 267
See application file for complete search history.

(56) References Cited

U.S. PATENT DOCUMENTS

| | | | | |
|---|---|---|---|---|
| 4,597,898 | A | 7/1986 | Vander Meer | 252/529 |
| 4,622,378 | A | 11/1986 | Gosselink | 528/66 |
| 4,664,848 | A | 5/1987 | Oh et al. | 252/547 |
| 5,669,984 | A | 9/1997 | Scheibel et al. | 134/25.2 |
| 6,121,226 | A | 9/2000 | Gosselink et al. | 510/400 |

FOREIGN PATENT DOCUMENTS

| | | |
|---|---|---|
| EP | 137 615 | 4/1985 |
| EP | 688 859 | 12/1995 |
| WO | 98/00508 | 1/1997 |
| WO | 97/43366 | 11/1997 |
| WO | 99/49009 | 9/1999 |
| WO | 00/63334 | 10/2000 |

OTHER PUBLICATIONS

PCT International Search Report in a PCT application PCT/EP 2005/000115.

Co–pending application: Applicant: Hsu et al., Filing Date: Sep. 17, 2003.

*Primary Examiner*—Necholus Ogden
(74) *Attorney, Agent, or Firm*—Rimma Mitelman

(57) ABSTRACT

A liquid laundry detergent composition comprising: (a) from about 0.1% to about 80%, by weight of the composition, of a polyanionic ammonium surfactant; (b) a liquid carrier; (c) wherein the composition is substantially free of bases having pKa equal to or greater than 10, other than nitrogen-based bases.

12 Claims, No Drawings

LIQUID LAUNDRY DETERGENT WITH POLYANIONIC AMMONIUM SURFACTANT

FIELD OF THE INVENTION

The present invention relates to liquid laundry detergent compositions comprising a polyanionic ammonium surfactant.

BACKGROUND OF THE INVENTION

Liquid laundry detergents are popular with the consumers. Despite numerous liquid detergent products on the market, however, a continuous consumer need exists for improved performance, especially if such can be achieved at a lower cost.

Specifically, consumers look for improved soil removal and improved whiteness and brightness, without having to pay a premium for such benefits. Polyamines, such as tetraethylene pentamine ("TEPA"), are known in petroleum production and refining operations as corrosion inhibitors, demulsifiers, neutralizers, and functional additives. Laundry applications use modified polyamines. See for instance, WO 00/63334, EP 137 615, U.S. Pat. No. 5,669,984, U.S. Pat. No. 4,664,848, WO 99/49009, U.S. Pat. No. 6,121,226, U.S. Pat. No. 4,622,378, and U.S. Pat. No. 4,597,898. Some of these documents describe aqueous detergent compositions which also incorporate anionic surfactants or fatty acids, or anionic surfactant precursors, in the presence also of strong caustic agents which are added to produce anionic surfactants from anionic surfactant acid precursors or fatty acid salts from fatty acids. The present invention is based at least in part on the discovery that polyanionic ammonium surfactants employed in the present invention exhibit different characteristics and perform substantially better at soil removal than physical mixtures of anionic surfactants/fatty acids and polyamines.

SUMMARY OF THE INVENTION

The present invention includes a liquid laundry detergent composition comprising:

(a) from about 0.1% to about 80%, by weight of the composition, of a polyanionic ammonium surfactant;

(b) a liquid carrier.

(c) wherein the composition is substantially free of bases having pKa equal to or greater than 10, other than nitrogen-based bases.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

Polyanionic Ammonium Surfactant ("PAAS")

The polyanionic ammonium surfactants suitable for use herein contain units having the structure formula:

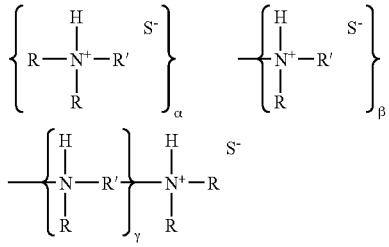

Where R is selected from hydrogen, linear or branched $C_1$–$C_4$ alkyl, $C_7$–$C_{12}$ Alkylaryl, $C_2$–$C_{12}$ alkylene, $C_3$–$C_{12}$ hydroxyalkylene, $C_4$–$C_{12}$ dihydroxyalkylene, $C_8$–$C_{12}$ Dialkylarylene, and

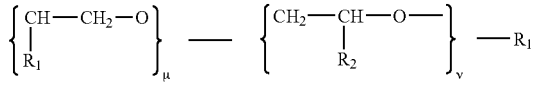

where μ and ν are in the range of 0 to 4 and the sum of μ and ν are between 1 and 4. $R_1$ is selected from hydrogen, linear or branched $C_1$–$C_4$ alkyl, $C_6$–$C_{12}$ Alkylaryl, $C_2$–$C_{12}$ Alkylene, $C_3$–$C_{12}$ hydroxyalkylene, $C_4$–$C_{12}$ dihydroxyalkylene and $C_8$–$C_{12}$ Dialkylarylene;

R2 is selected from R1 and amine oxide;

R' is a linking connecting the nitrogen atoms of the backbone. R' units are selected from $C_2$–$C_{12}$ alkylene, $C_4$–$C_{12}$ alkenylene, $C_3$–$C_{12}$ hydroxyalkylene wherein the hydroxyl moiety may take any position on the R' unit chain except the carbon atoms directly connected to the polyamine backbone nitrogen; $C_4$–$C_{12}$ dihydroxyalkylene wherein the hydroxyl moieties may occupy any two of the carbon atoms of the R' unit chain except those carbon atoms directly connected to the backbone nitrogen. The values of α, β, and γ are between 0 to 10 and the sum of α and β is greater than or equal to 1. The total number of amine groups for the present invention is between 2 to 10.

$S^-$ is a conjugated base of anionic surfactant acid ($S^-$—$H^+$) with a HLB number in the range of 2 to 45.

$S^-$ may be expressed as $$R_3\text{–}L^-$$

Where $R_3$ is selected from straight or branched $C_6$–$C_{22}$ alkyl, $C_6$–$C_{22}$ Alkylene, $C_6$–$C_{22}$ polyoxyalkylenealkyl, $C_6$–$C_{22}$ polyoxyalkylenatacyl, $C_6$–$C_{22}$ alkylaryl, Rosin derivatives, $C_6$–$C_{22}$ N-acylalkyl; $C_6$–$C_{22}$ α-sulfonatedtalkyl, $C_6$–$C_{22}$ hydroxyalkyl, and $C_6$–$C_{22}$ hydroxyalkylene;

Where $L^-$ is selected from $COO^-$, $SO_3^-$, $OSO3^-$, phosphoric acid, phosphorous acid, amino acids, aromatic carboxylic acid, sugar base acids derived from oxidation of monosaccharides and polysaccharides.

The preferred PAAS in the inventive compositions is selected from polyanionic ammonium alkyl benzene sulfonate, polyanionic ammonium alkyl sulfate, polyanionic ammonium fatty acid salt, polyanionic ammonium alkyl polyalkoxy sulfate and mixtures thereof.

The amount of PAAS employed in the inventive compositions is in the range of from 0.1% to 80%, preferably from 1% to 60%, most preferably from 5% to 40%.

Liquid Carrier

The inventive compositions are liquid and therefore contain a liquid carrier. PAAS is generally dispersed or dissolved in the liquid carrier, for optimum performance. A liquid carrier is a liquid at and above 15° C., preferably above 10° C., and most preferably above 0° C.

A typical liquid carrier in the inventive compositions is aqueous—that is, the inventive compositions comprise generally from 20% to 99.9%, preferably from 40% to 80%, most preferably, to achieve optimum cost and ease of manufacturing, from 50% to 70% of water. Other liquid components, such as solvents, surfactants, liquid organic matters including organic bases, and their mixtures can form the liquid carrier.

Solvents that may be present include but are not limited to alcohols, surfactant, fatty alcohol ethoxylated sulfate or surfactant mixes, alkanol amine, polyamine, other polar or non-polar solvents, and mixtures thereof. The liquid carrier is employed in an amount of from 20% to 99.9%.

pH

The pH of the inventive compositions is generally equal to or greater than 5.0, preferably greater than 6.0, most preferably greater than 6.5. When the pH of the inventive composition is too low, a portion of anionic surfactants remain in their conjugated acid form, rather than forming a PAAS surfactant. Conjugated acids are poor in detergency or in some cases they are classified as a soil (e.g., fatty acids).

The pH of the inventive compositions is generally in the range of from 5 to 10, preferably not greater than 9.5, in order to attain maximum efficacy at a minimum cost. The pH of the inventive compositions may exceed 10, but not through the presence of strong bases, other than nitrogen-based strong bases. In other words, when pH is greater than 10 the only strong bases that may be present in the composition are nitrogen-based strong bases; the composition at pH of 10 and greater should be substantially free of other strong bases such as for instance alkali hydroxides (sodium hydroxide, potassium hydroxide). While not wishing to be bound by this theory, it is believed that in the presence of strong bases, other than nitrogen-containing bases, at a pH of 10 and higher, the PAAS surfactant ionises and undergoes ion exchange with the strong base. If the strong base is nitrogen-based, the ion exchange merely results in the re-formation of PAAS surfactant, with no detrimental effect on performance. If the strong base is not nitrogen-based, the level of PAAS surfactant is reduced, which may lead to reduced performance.

"Strong Base" as used herein means a base with pKa equal to or greater than 10.

Examples of nitrogen-containing bases include but are not limited to ammonia, polyamine, alkanolamine, alkylamine, alkyleneamine, piperazine, morpholineine, alkyl/alkylether morpholines, triazine, ist derivatives, cyclic amines, aromatic amines including pyridine, alkoxylated amines, polyethylene imines EDA, ethyleneamines, dimethylpropaneamine. Polyamine is a chemical molecule, which contains more than one amine group, such as ethylene diamine (EDA), diethylenetriamine (DETA), triethylenetetramine (TETA), tetraethylenepentamine (TEPA).

Examples of strong bases other than nitrogen-based bases include but are not limited to alkaline hydroxides (sodium hydroxide, potassium hydroxide, lithium hydroxide), alkaline alkoxides, sodium hydride, alkaline carbonate, sodium silicates (e.g., sodium metasilicate), alkaline pyrophosphate.

pKa values of some commonly used bases are given in the table below for easy reference. The strong bases such as alkali hydroxide, alkali alkoxide are fully dissociated in water, and pH value depends on the concentration of the strong base. According to Organic Chemistry (John McMurry, Organic Chemistry, p. 45, Brooks/Cole Publishing Company, 1984), ethoxide $CH_3CH_2O^-$, and hydroxide $OH^-$ have pKa values of 16 and 15.74, respectively. Correspondingly, the pH values for 0.01 N KOH and NaOH are 12.0, and their 1.0 N aqueous solutions have a pH of 14.0.

| Base | | pKa |
|---|---|---|
| Ammonia | | 9.25 |
| $M^+OH^-$ | | 15.74 |
| $M^+OR^-$ | | 16.00 |
| Methylamine | | 10.66 |
| Methylhydroxylamine | | 12.50 |
| Ethylamine | | 10.65 |
| Dimethylamine | | 10.73 |
| Ethanolamine | | 9.50 |
| 1,2-Ethanediamine; | $pKa_1$ | 9.92 |
| | $pKa_2$ | 6.82 |
| Propropylamine | | 10.54 |
| Isopropylamine | | 10.63 |
| Trimethylamine | | 9.80 |
| 2-mthyloxyethylamine | | 9.40 |
| 1,2-propanediamine; | $pKa_1$ | 9.82 |
| | $pKa_2$ | 6.61 |
| 1,3-propanediamine; | $pKa_1$ | 10.55 |
| | $pKa_2$ | 8.88 |
| 1,2-diamino-2-propanol; | $pKa_1$ | 9.69 |
| | $pKa_2$ | 7.93 |
| 1,2,3-triaminopropane; | $pKa_1$ | 9.59 |
| | $pKa_2$ | 7.95 |
| Butylamine | | 10.60 |
| diethylamine | | 10.84 |
| Trisamine | | 8.30 |
| 1,4-Butanediamine | | 10.80 |
| Pentylamine | | 10.63 |
| 2,2-dimethylpropylamine | | 10.15 |
| 1,5-pentanediamine; | $pKa_1$ | 10.25 |
| | $pKa_2$ | 9.13 |
| Cyclohexylamine | | 10.64 |
| Diisopropylamine | | 11.05 |
| Triethylamine | | 10.75 |
| Triethanolamine | | 7.76 |
| 1,6-Hexanediamine; | $pKa_1$ | 11.86 |
| | $pKa_2$ | 10.76 |
| N,N,N',N'-Tetramethyl1,2-ethanediamine; | $pKa_1$ | 10.40 |
| | $pKa_2$ | 8.26 |
| Ethylenediamine (EDA) | | 9.90* |
| Diethylenetriamine (DETA) | | 9.90* |
| Triethylenetetramine (TETA) | | 9.80* |
| Tetraethylenepentamine (TEPA) | | 9.80* |

From CRC Handbook of Chemistry and Physics, 83rd Edition except *From "Amine applications and properties data applications" Huntsman Technical Bulletin.

The "base" as discussed herein means the base added as a free base or the base that may form at a particular pH from various salts present in the composition.

"Substantially free" as used herein means that the amount of a strong base, other than nitrogen based, is less than concentration of 0.0001N.

Thus, an aqueous detergent composition comprising a PAAS surfactant wherein the measured pH is below 10 is within the scope of the invention. Also within the scope of this invention is an aqueous detergent composition comprising a PAAS surfactant and wherein the measured pH of the finished composition is equal to or higher than 10 due to the addition of excess nitrogen based strong base. To ascertain whether the composition is within the scope of the invention, the nitrogen based base(s) may be distilled out and the remaining composition should have a pH less than 10. In addition, a combination of standard techniques such as ion chromatography and NMR or liquid chromatography coupled with mass spectrometry detection can be used to measure both total and free base content. This approach has the added benefit of providing positive chemical identification for each of the basic components present in the composition.

Process of Making

The composition is preferably prepared by contacting a polyamine and a conjugate acid of an anionic surfactant in the presence of a liquid carrier, preferably water. For a composition comprised of both PAAS and mono-anionic surfactants (e.g., LAS, PAS, LES, fatty acid soap) the contacting of conjugate acid and polyamines and bases other than polyamines may be in any order. However, the amounts of bases other than polyamine should not be greater than the required stoichiometric amounts for preparing mono-anionic surfactants. Furthermore, the amounts of polyamine should be in the range of equal or less than 50% of the molar equivalent of the conjugate acid of a polyamine, otherwise, it will form a mono-anionic polyamine surfactant, which is not PAAS. If the composition also comprised of other surfactants, solubilizers, hydrotropes, builders and buffering agents; these ingredients may be added before, during or after the contacting of a polyamine and a conjugate acid. Nevertheless, in-situ preparation of salts, such as sodium citrate, by reacting the acid with bases, e.g. NaOH or KOH, is preferably prepared before the forming of PAAS. For certain ingredients, which are acid sensitive, such as alkyl ether sulfate, it is preferably added after the forming of PAAS. As is well known in the art, minor ingredients such as fragrance, enzyme, functional polymers, bleach system, colorant, fluorescent whitening agent, and preservatives are preferably post-dosed at the end of preparation.

A typical composition may be prepared by first preparing a main mix by mixing water, 70% sorbitol solution, borax, propylene glycol, sodium citrate. After borax is dissolved under moderate agitation, a polyamine, e.g. TEPA (tetraethylenepentamine) is added to the main mix. Anionic surfactant acids, including fatty acid, are then added to the main mix. Mixing is continued until both acids are fully dispersed and consumed. Nonionic surfactant may be added before, during or after the addition of anionic surfactant acids. Optionally, a solubiliser, e.g. alkyl ether sulfate or nonionic surfactant, is then added to the main mix and the mixing is continued so as to form a homogeneous solution. If included, F-dye is then added to the mixture. The mixing is continued until a homogeneous liquid detergent composition is formed.

Optional Ingredients

The inventive compositions may include non-neutralized polyamine and alkyl benzene sulfonate salts and/or alkyl sulfate salts and/or fatty acid salts, in addition to the PAAS surfactant of the present invention.

Solubiliser

Unlike polyamines, the PAAS included in the inventive compositions are dispersible (not soluble or not entirely soluble) in water. Hence, the inventive compositions, especially when aqueous-based, preferably include a solubiliser for PAAS. The solubiliser is selected from the group consisting of water soluble surfactants, solvents (such as propylene glycol, glycerin, and ethanol), and the mixture of them, and is preferably selected from nonionic surfactants (such as C8–C18 Alkane with 5–15 EO groups) and/or alkyl polyethoxy sulfate, due to their ability to help in the formation of the mixed micelles while having great solubilizing ability.

For an isotropic liquid detergent, the minimum ratio of solubilizer to PAAS is 1:4, generally in the range of from 1:4 to 4:1, by weight percentage; preferably in the range of from 1:3 to 3:1, and most preferably from 1:2 to 2:1. However, PAAS can also be dispersed or dispensed in a liquid detergent medium, therefore no solubilizer is needed to obtain the cleaning performance.

Fluorescent Whitening Agent ("FWA")

It has been surprisingly discovered, as part of the present invention, that the deposition of the FWA is substantially enhanced in the presence of the PAAS of the invention. Accordingly, the inventive compositions preferably include from 0.01% to 2.0%, more preferably from 0.05% to 1.0%, most preferably from 0.05% to 0.5% of a fluorescer. Examples of suitable fluorescers include but are not limited to derivative of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

Additional Surfactant

The compositions of the invention may, but do not have to contain additional surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl sulfonates, alkyl sulfonates, alkyl sulfates and the alkyl poly ether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine sulfate can be used in admixture with the alkylbenzene sulfonate in an amount of 0 to 70%, preferably 5 to 50% by weight.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Nonionic surfactants which can be used with the invention, alone or in combination with other surfactants are described below.

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1$^{(R)}$ series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—(R^2O)_y\text{-}(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; 0 is an oxygen atom;

y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4). Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0–75% by wt., preferably 5 to 50%, more preferably 5 to 25% by wt. of the composition.

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine. Sodium 3-(dodecylamino) propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of additional surfactant used may vary from 1 to 85% by weight, preferably 10 to 50% by weight.

As noted the preferred surfactant systems of the invention are mixtures of anionic and nonionic surfactants.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may be used in the compositions of the invention.

If a lipase is used, the lipolytic enzyme may be either a fungal lipase producible by Humicola lanuginosa and Thermomyces lanuginosus, or a bacterial lipase which show a positive immunological cross-reaction with the antibody of the lipase produced by the microorganism Chromobacter viscosum var. lipolyticum NRRL B-3673.

An example of a fungal lipase as defined above is the lipase ex Humicola lanuginosa, available from Amano under the tradename Amano CE; the lipase ex Humicola lanuginosa as described in the aforesaid European Patent Application 0,258,068 (NOVO), as well as the lipase obtained by cloning the gene from Humicola lanuginosa and expressing this gene in Aspergillus oryzae, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about .1–10, more preferably .5–7, most preferably 1–2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected sos that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application. A pH jump heavy duty liquid is a composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixojels 1, 2, 3 and 4 by Georgia Kaolin Co. These bentonites are known to soften textiles as described in British Patent No. 401, 413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added in small effective amounts, although it should be noted that the inventive compositions are low-foaming.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, additional soil release polymers and cationic softening agents may be used.

Preferably, the detergent composition is a colored composition packaged in the transparent/translucent ("see-through") container.

Container

Preferred containers are transparent/translucent bottles. "Transparent" as used herein includes both transparent and translucent and means that a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic co-polymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of Using Compositions

In use, the indicated quantity of the composition (generally in the range from 50 to 200 ml) depending on the size of the laundry load, the size and type of the washing machine, is added to the washing machine which also contains water and the soiled laundry. The inventive compositions are particularly suited for use with front-loading washing machine, due to the ability of the inventive compositions to deliver high performance with low foaming—front-loading machines require low foaming compositions.

The following specific examples further illustrate the invention, but the invention is not limited thereto.

The abbreviations in the Examples denote the following:

TEPA: Tetraethylenepentamine

NA-LAS: Sodium alkylbenzenesufonate

LAS acid: alkylbenzenesulfonic acid

Na-LES: Sodium alkylpolyethoxysulfate
EDA: Ethylene diamine
DETA: Diethylenetriamine

EXAMPLE 1 AND COMPARATIVE EXAMPLE 1A

This example demonstrates one of the differences in one of the physical properties (water solubility) between PAAS surfactant employed in the present invention and TEPA and Na-LAS mixtures in the prior art.

In Example 1 (within the scope of the invention), when LAS acid was neutralized with a polyamine (i.e., TEPA), it formed PAAS. As PAAS began forming, the solution became hazy. Upon further addition of the LAS acid, the hazy solution became a dispersion. Upon standing for hours, the dispersion formed a layer of sediment at the bottom of the beaker. Even a very diluted formulation (such as below 0.1%) was hazy.

TEPA has multiple nitrogen sites. Without wishing to be limited by this theory, it is believed that upon continued addition of LAS acid, the PAAS formed different compounds and gave different assemblies. At the beginning of addition of LAS acid, only single nitrogen atom was protonated, forming a micellar solution, which is a clear solution. Upon the addition of more LAS acid, multiple nitrogen atoms were protonated. PAAS eventually precipitated from the solution because of the lack of ionization of the PAAS due to the strong ion-bond formation between LAS and TEPA and internal hydrophobic interaction.

In Example 1A (outside the scope of the invention) the behavior was completely different: Na-LAS solution with added TEPA gave a clear solution throughout the titration of LAS acid and remained clear upon addition of TEPA.

The solution was clear at the all time over the entire pH range, leading to the conclusion that Na-LAS was fully ionized or disassociated. The clarity of solution did not change upon the addition of TEPA for the pH from 2.5 to 10.0. It indicates that the addition of TEPA does not convert Na-LAS to PAAS.

This means that PAAS formed much stronger assemblies than Na-LAS and TEPA physical mixture. PAAS could not be dispersed in single molecular state but dispersed as aggregates.

The results that were obtained for Examples 1 and 1A are summarised in Tables 1 and 1A respectively.

TABLE 1

| Ingredient | Wt (g) | Observations |
|---|---|---|
| Water | 94.0 | Clear |
| TEPA | 2.0 | Clear |
| LAS acid | 2.6 | Hazy solution, pH 10.50 |
| | 6.0 | Hazy dispersion, pH 9.95 |
| | 7.4 | Dispersion, pH 9.60 |
| | 9.0 | Dispersion, pH 9.03, after standing hours at room temperature precipitate was formed on the bottom of the beaker. |

TABLE 1A

| Ingredient | Wt (g) | Results |
|---|---|---|
| Water | 96.00 | |
| NaOH, 50% | 1.60 | |
| LAS acid | 6.38 | pH = 2.5; a clear solution |

TABLE 1A-continued

| Ingredient | Wt (g) | Results |
|---|---|---|
| TEPA | 0.11 | pH = 7.78; a clear solution |
| | 0.15 | pH = 10.0; a clear solution |

EXAMPLE 2

Example 2 (within the scope of the invention) demonstrates that PAAS surfactant is a strongly bonded molecule, which does not exchange counterions with other salts. Sodium xylenesulfonate was added to an aqueous PAAS dispersion to attempt to solubilize PAAS by ion-exchange and/or hydrotrope mechanism. The results that were obtained are summarised in Table 2.

TABLE 2

| Ingredient | Wt (g) | Observations |
|---|---|---|
| PAAS preparation | | |
| Water | 98.0 | |
| LAS acid | 6.38 | |
| TEPA | 2.0 | PAAS formed (7.8% concentration). Looked as milky dispersion. After standing several days at room temperature, precipitate was formed. |
| PAAS (7.8%) | 20.0 | |
| Water | 300.0 | |
| Sodium xylenesulfonate (40%) | 20.5 | still hazy and eventually TEPA-LAS precipitates are found in the solution |

The concentration of PAAS in the above formulation was 0.46%. The molar ratio of sodium xylenesulfonate to PAAS was 21:1.

There was enough Na xylenesulfonate for PAAS to change counter ions from TEPA to Na. However, PAAS did not ionize and remained as a dispersion. It indicated that the bond between polyamine and conjugated acid of PAAS is very strong.

EXAMPLE 3

Example 1 was repeated, except that fatty acid was used in place of LAS acid.

A phenomenon similar to that of Example 1 (formation of a dispersion insoluble in water) was observed for the product of fatty acid and polyamine. The results that were obtained are summarised in Table 3.

TABLE 3

| Ingredient | Wt (g) | Observations |
|---|---|---|
| Water | 92.0 | |
| Coco acid | 10.35 | |
| TEPA | 2.6 | Hazy solution, |
| | 3.15 | Hazy dispersion, and after standing, a phase separation occurred (precipitates formed in the bottom). |

EXAMPLE 4

This example investigated the solubilization of PAAS in water, with the aid of a solubiliser. A dispersion of PAAS (with LAS and fatty acid as conjugated acid) was mixed with Na-LES solution (59.5% Na-LES, 10% propylene glycol, 6.5% ethanol, and balance of water). The result was a clear solution.

TABLE 4

| Ingredient | Wt (g) | Observations |
|---|---|---|
| Water | 53.24 | |
| Sorbitol (70%) | 4.65 | |
| Borax | 2.3 | |
| Propylene glycol | 1.0 | |
| TEPA | 2.0 | |
| LAS acid | 6.25 | Hazy solution |
| Coco acid | 1.0 | Hazy solution, pH = 8.20 |
| Na-LES (59.5%) | 16.88 | Stable clear solution, no phase separation was observed. |

EXAMPLE 5

This example investigated the interaction between negative charges on a polycarboxylate polymer and positive charges on PAAS.

A polyacrylate-based anti-redeposition agent is well known for its soil anti-redeposition and soil-release performance in Na-LAS or/and Na-fatty acid salt type of formulations. Surprisingly, in the case of PAAS formulations, this performance benefit from the polymer was not observed. Indeed, the addition of polyacrylate-base anti-redeposition agent resulted in an adverse effect on soil removal.

These results indicated that there is interaction between negative charges on the polyacrylate and positive charges on PAAS. The interaction destroyed the benefits of anti-redeposition and the particulate soil removal. Thus, the inventive compositions preferably exclude polycarboxylate polymers or other negatively charged polyionic polymers.

Particulate Soil Removal Evaluation ( Soil Release Index ("SRI") measurement)): Evaluation for removal of particulate soil was conducted from a single wash in warm water at 90° F. A split stain methodology was used and a benchmark detergent was also tested for the purpose of comparison. The fabric used in test was polyester. A Hunter reflection meter was used to measure L, a, and b. These values were taken to calculate SRI Index values using the following equation:

$$SRI=100-[(L_f-L_i)^2-(a_f-a_i)^2-(b_f-b_i)^2]^{1/2},$$

where subscripts of "i" and "f" represent the initial and final stages of wash.

The results that were obtained are summarised in Table 5.

TABLE 5

| Composition | 5-1 | 5-2 |
|---|---|---|
| LAS acid | 6.00 | 6.00 |
| Non-ionic (C12–C14, 9 EO) | 6.60 | 6.60 |
| Oleic Fatty Acid | 3.00 | 3.00 |
| Coconut Fatty Acid | 1.00 | 1.00 |
| Na-LES, 59.5% solution | 16.81 | 16.81 |
| Sorbitol (70% solution) | 4.64 | 4.64 |
| Sodium Citrate.2H2O | 3.00 | 3.00 |
| TEPA | 2.00 | 2.00 |
| Anti-redeposition agent (polyacrylate base) | | 0.30 |
| Propylene Glycol | 1.00 | 0 |
| water and miscellaneous | To 100 | To 100 |
| SRI (Soil Removal Index) | 77.50 | 67.49 |

EXAMPLE 6 AND CONPARATIVE EXAMPLES 6A AND 6B

Examples 6, 6A and 6B investigated the foaming performance of PAAS (Example 6) compared with NA-LAS/TEPA mixtures (Examples 6A and 6B). Example 6A (outside the scope of the invention) was prepared by adding TEPA at the end of the process (when Na-LAS was already formed), and 6B (also outside the scope of the invention) was without TEPA.

The foam properties with a surfactant solution at a concentration of 0.23% by weight were measured by use of Ross-Mile method described in ASTM D 1173-53. The results that were obtained are summarised in Table 6.

TABLE 6

| | Example | | |
|---|---|---|---|
| | 6 | 6A | 6B |
| Alkyl benzene Sulfonic acid | 6.00 | 6.00 | 6.00 |
| Non-ionic (C12–C14, 9 EO) | 6.60 | 6.60 | 6.60 |
| Oleic Fatty Acid | 3.00 | 3.00 | 3.00 |
| Coconut Fatty Acid | 1.00 | 1.00 | 1.00 |
| Na-LES, 59.5% solution | 16.81 | 16.81 | 16.81 |
| Propylene glycol | 1.00 | 1.00 | 1.00 |
| ethanol | 0.65 | 0.65 | 0.65 |
| Sorbitol (70% solution) | 4.64 | 4.64 | 4.64 |
| Sodium Citrate.2H2O | 3.00 | 3.00 | 3.00 |
| TEPA | 2.00 | 2.00 | |
| NaOH (50%) | | 2.00 | 1.96 |
| Citric acid.H2O | | 0.65 | 0.00 |
| Propylene Glycol | 1.00 | 1.00 | 3.00 |
| water and Miscellaneous | To 100 | To 100 | To 100 |
| Foam height, initial, mm | 50 | 76 | 73 |
| Foam height, 5 min., mm | 45 | 61 | 49 |

It can be seen from the results in Table 6 that Example 6 (within the scope of the invention), a PAAS formulation, had the lowest initial and 5 minutes foam height. The initial foam height is a determinative value, since even if the foam is reduced after 5 minutes, initial high foaming will make it unsuitable for use in front-loading machines.

It was also noted that Example 6 was a clear solution, but when diluted at a concentration of 0.23%, Example 6 gave a little hazy solution, indicating that the diluted solution did not contain sufficient amount of the solubiliser to keep PAAS solubilised. Examples 6A and 6B (both TEPA/Na-LAS or Na-LAS alone, both outside the scope of the invention) gave a clear solution, originally and when diluted.

EXAMPLE 7 AND COMPARATIVE EXAMPLE 7A

Examples 7 and 7A investigated the performance of PAAS formulation (Example 7) compared with Na-LAS and TEPA mixture (Example 7A).

Example 7 (within the scope of the invention) was prepared by first preparing a main mix by mixing water, 70% sorbitol solution, Borax, propylene glycol, sodium citrate. After borax was dissolved under moderate agitation, TEPA (tetraethylenepentamine) was added to the main mix. Sulfonic acid and coconut fatty acid were then added to the main mix. Mixing was continued until both acids were fully dispersed and consumed. The 59% active LES blend (59% Alkyl ether sulfate, 10% propylene glycol, 6.5% ethanol and water) was then added to the main mix and the mixing was continued so as to form a homogeneous solution. F-dye was added to the mixture. After F-dye was dissolved, oleic acid and nonionic surfactant (Neodol 25-9) were added. The mixing was continued until a homogeneous liquid detergent composition was formed.

Example 7A (outside the scope of the invention) was prepared by following the same procedure as Example 7, with a crucial diffrence that NaOH (50%) aqueous solution was added to the main mix right after the dissolution of borax and the adjustment of pH by citric acid at the end of preparation, so that Na-LAS and Na-fatty acid with TEPA was present in Example 7A, instead of PAAS surfactant as in Example 7.

SRI was measured as described in Example 4 above. The results that were obtained are summarised in Table 7.

TABLE 7

| | Example | |
|---|---|---|
| | 7 | 7A |
| LAS acid | 6.00 | 6.00 |
| Non-ionic (C12–C14, 9 EO) | 6.60 | 6.60 |
| Oleic Fatty Acid | 3.00 | 3.00 |
| Coconut Fatty Acid | 1.00 | 1.00 |
| Na-LES, 59.5% solution | 16.81 | 16.81 |
| Sorbitol (70% solution) | 4.64 | 4.64 |
| Sodium Citrate.2H2O | 3.00 | 3.00 |
| TEPA | 2.00 | 2.00 |
| NaOH (50% solution) | 0.00 | 2.00 |
| Citric acid.H2O | 0.00 | 0.65 |
| Propylene Glycol | 1.00 | 1.00 |
| water and Miscellaneous | To 100 | To 100 |
| SRI | 75.56 | 71.39 |
| Extra Citrate | 0 | 0.65% |
| PH, wash condition | 7.94 | 8.50 |

As shown in Table 7, both Examples 7 and 7A had the same amount of TEPA. Example 7A had more citrate and higher pH than Example 7. In general, the presence of citrate helps in stain/particulate soil removal and a high pH formulation enhances the stain removal performance. Surprisingly, Example 7 was found to give a better performance than Example 7A, despite higher citrate and pH of Example 7A. The fundamental difference is PAAS was pre-formed and used in Example 7, whereas Na-LAS and Na-soap were formed and used for Example 7A instead of PAAS.

EXAMPLES 8–14

The following examples 8 to 14 (all within the scope of the invention) were also prepared following the procedure of Example 7. The compositions of the Examples that were prepared is summarised in Table 8.

All the examples were isotropic and stable at room temperature for at least 3 months.

EXAMPLE 15 AND COMPARATIVE EXAMPLE 15A

Examples 15 and 15A investigated FWA deposition from the PAAS containing compositions of the invention (Example 15) as compared to TEPA-NaLAS compositions outside the scope of the invention (Example 15A).

Fluorescent Whitening Agent (FWA) Deposition Evaluation

FWA is a colorant that absorbs near ultraviolet (UV) radiation and re-emits visible (violet-blue) radiation. This causes a yellowish material to which it has been applied to appear whiter. Evaluation for FWA deposition was conducted from a single wash in warm water at 32° C. The fabric used in test was cotton, nylon, polyester/cotton blend, and knit (cotton/polyester/spandex). AATCC Test Method 110-2000 was used in determining the deposition of FWA. A Hunter reflection meter with polychromatic light (full spectrum) and has a relative spectral power distribution approximating illuminant $D_{65}$ from 330–700 nm was used for the measurement. An Ultraviolet cut-off filter was used to insert into the incident light beam. The difference between the measurements taken before and after the insertion of the ultraviolet cut-off filter provide an indication of the enhancement of the apparent whiteness due to the addition of an FWA.

The whiteness index, $W_{10}$, may be calculated by $$W_{10}=Y_{10}+800\ (0.3138-x_{10})+1700(0.3310-y_{10}),$$

And $$40<W_{10}<5\ Y_{10}-280,$$

Where $Y_{10}$, $x_{10}$, $Y_{10}$ are the chromaticity coordinates of the specimen, and 0.3138 and 0.3310 are, respectively, the $x_{10}$ and $y_{10}$ chromaticity coordinates for the perfect diffuser.

$W_{10}$ values are directly correlated to the degree of deposition of FWA. The higher the value of $W_{10}$, the greater the whiteness.

Surprisingly, it was discovered that the presence of PAAS surfactant in a formulation greatly improves the deposition

TABLE 8

| | Example | | | | | | |
|---|---|---|---|---|---|---|---|
| | 8 | 9 | 10 | 11 | 12 | 13 | 14 |
| LAS acid | 5.26 | 6.00 | 5.26 | 6.00 | 6.00 | 6.00 | 6.00 |
| Non-ionic (C12–C14, 9 EO) | 5.79 | 6.00 | 5.79 | 6.00 | 6.00 | 6.60 | 6.60 |
| Oleic Fatty Acid | 2.63 | 5.00 | 2.60 | 5.00 | 5.00 | 3.00 | 3.00 |
| Coconut Fatty Acid | 0.88 | | 0.88 | | | 1.00 | 1.00 |
| Na-LES, 59.5% solution | 14.74 | 13.45 | 16.81 | 13.45 | 13.45 | 16.81 | 16.81 |
| Sorbitol (70% solution) | 4.00 | 4.64 | 4.64 | 4.64 | 4.64 | 4.64 | 4.64 |
| Sodium Citrate.2H2O | 2.63 | 3.00 | 3.00 | 3.00 | 3.00 | 3.00 | 3.00 |
| TEPA | 1.75 | 1.20 | | | | 2.00 | 2.00 |
| EDA | | | 1.8 | | | | |
| DETA | 0.00 | 0.00 | 0.00 | 0.64 | 0.96 | 1.80 | 0.00 |
| NaOH (50% solution) | 0.00 | 0.76 | 1.21 | 0.76 | 0.76 | 0.00 | 0.00 |
| MEA | | | | | | | 0.95 |
| Propylene Glycol | 1.75 | 0.00 | 1.0 | 0 | 0 | 1.00 | 1.00 |
| water and Miscellaneous | To 100 | To 100 | To 100 | To 100 | To 100 | To 100 | To 100 |
| SRI* | | 82.0 | | 78.5 | 78.9 | | |

*Particulate soil on polyester of F-dye onto a fabric to enhance the whiteness. The formulations are summarised in Table 9. F-dye deposition results that were obtained are summarised in Table 9A.

TABLE 9

| | Example | |
|---|---|---|
| | 15 | 15A |
| alkyl benzene Sulfonic acid | 6.00 | 6.00 |
| Non-ionic (C12–C14, 9 EO) | 6.60 | 6.60 |
| Oleic Fatty Acid | 3.00 | 3.00 |
| Coconut Fatty Acid | 1.00 | 1.00 |
| Na-LES, 59.5% solution | 16.81 | 16.81 |
| Sorbitol (70% solution) | 4.64 | 4.64 |
| Sodium Citrate.2H2O | 3.00 | 3.00 |
| TEPA | 2.00 | 0.00 |
| NaOH (50% solution) | 0.00 | 1.96 |
| Propylene Glycol | 1.00 | 1.00 |
| water and miscellaneous | To 100 | To 100 |

TABLE 9A

| | Example | | | |
|---|---|---|---|---|
| | 15 | 15A | | |
| Fabric | $W_{10}$*, | $W_{10}$*, TEPA | $\Delta W_{10}$** | Enhancement in F-dye deposition*** |
| Cotton | 39.04 | 38.12 | 0.92 | 2.41% |
| 50/50 Blend (cotton/polyester) | 49.94 | 46.66 | 3.28 | 7.03% |
| 55/35/10 (cotton/polyester/spandex) | 66.00 | 62.76 | 3.24 | 5.16% |
| Nylon | 7.98 | 6.81 | 1.17 | 17.18% |

*$W_{10}$: Delta of Whiteness for fabric with particulate soil
**$\Delta DW\ W_{10}$: = $W_{10}$ (Example 15) − $W_{10}$ (Example 15A)
***Enhancement in F-dye deposition = $\Delta W_{10}/W_{10}$ (Example 15A) * 100%

Comparison of the results of Examples 15 and 15A clearly shows that the presence of PAAS greatly enhances the FWA deposition.

What is claimed is:

1. A liquid laundry detergent composition comprising:

(a) from about 0.1% to about 80%, by weight of the composition, of a polyanionic ammonium surfactant;

(b) a liquid carrier, (c) a fluorescent whitening agent, (d) wherein the composition is substantially free of bases having pKa equal to or greater than 10, other than nitrogen-based bases.

2. The composition of claim 1 further comprising a solubilizing agent.

3. The composition of claim 1 wherein the weight ratio of the solubilizing agent to the polyanionic ammonium surfactant is in the range of from 1:4 to4:1.

4. The composition of claim 1 wherein the initial foaming height of the composition is less than 65 mm.

5. The composition of claim 1 wherein the polyanionic ammonium surfactant is selected from the group consisting of polyanionic ammonium alkyl benzene sulfonate, polyanionic ammonium alkyl sulfate, polyanionic ammonium fatty acid salt, polyanionic ammonium alkyl polyalkoxy sulfate and mixtures thereof.

6. The composition of claim 1 wherein the composition is free of polycarboxylic polymer.

7. A method of improving soil removal from soiled garments, the method comprising adding into a laundry washing machine the composition of claim 1.

8. A method of improving the deposition of a fluorescent whitening agent on garments, the method comprising adding into a laundry washing machine the composition of claim 1.

9. A method of washing laundry in a front-loading washing machine, the method comprising adding to the washing machine the composition of claim 1.

10. The composition of claim 1 wherein the polyanionic ammonium surfactant is dispersed in a liquid carrier.

11. The composition of claim 1 wherein the polyanionic ammonium surfactant is solubilized in a liquid carrier.

12. The composition of claim 1 wherein the liquid carrier comprises water.

* * * * *